US009175530B2

(12) United States Patent
Eia et al.

(10) Patent No.: US 9,175,530 B2
(45) Date of Patent: Nov. 3, 2015

(54) WELLBORE FLUID MIXING SYSTEM

(75) Inventors: Jan Thore Eia, Kvernaland (NO); Peter Wright, Hundvag (NO); Magnar Kongestol, Fana (NO)

(73) Assignee: Schlumberger Norge AS, Tananger (NO)

( * ) Notice: Subject to any disclaimer, the term of this patent is extended or adjusted under 35 U.S.C. 154(b) by 1140 days.

(21) Appl. No.: 12/743,137

(22) PCT Filed: Nov. 19, 2008

(86) PCT No.: PCT/EP2008/065842

§ 371 (c)(1),
(2), (4) Date: Aug. 26, 2010

(87) PCT Pub. No.: WO2009/065858

PCT Pub. Date: May 28, 2009

(65) Prior Publication Data

US 2010/0319921 A1 Dec. 23, 2010

Related U.S. Application Data

(60) Provisional application No. 60/988,988, filed on Nov. 19, 2007.

(51) Int. Cl.
*E21B 21/06* (2006.01)
*B01F 5/10* (2006.01)
*B01F 15/02* (2006.01)

(52) U.S. Cl.
CPC ..... *E21B 21/062* (2013.01)

(58) Field of Classification Search
CPC ..... E21B 21/062
USPC ..... 366/336, 137, 138, 174, 175.2, 182.2, 366/191, 182.1, 182.3, 182.4, 136; 166/305.1
See application file for complete search history.

(56) References Cited

U.S. PATENT DOCUMENTS 3,565,404 A * 2/1971 Reid et al. ..... 366/137
4,265,266 A * 5/1981 Kierbow et al. ..... 137/101.19

(Continued)

FOREIGN PATENT DOCUMENTS

WO 02/44517 A1 6/2002
WO 2006/109040 A1 10/2006

OTHER PUBLICATIONS

International Search Report issued in PCT/EP2008/065842, mailed on Mar. 17, 2009, 5 pages.

(Continued)

*Primary Examiner* — Tony G Soohoo

(57) ABSTRACT

A system for mixing fluids for oilfield applications, the system including a first storage vessel (101) configured to hold a first material and a first mixing device (108) in fluid communication with the first storage vessel. The system also including a second mixing device (115) in fluid communication with the first mixing device and a second storage vessel (102) in fluid communication with the second mixing device, wherein the second storage vessel is configured to hold a second material. Additionally, the system including a pump (109) in fluid communication with at least the second storage vessel and the first mixing device, wherein the pump is configured to provide a flow of the second material from the second storage vessel to the first mixing device, and wherein the first mixing device is configured to mix the first material and the second material to produce a wellbore fluid.

12 Claims, 8 Drawing Sheets

(56) References Cited

U.S. PATENT DOCUMENTS

| | | | | |
|---|---|---|---|---|
| 4,444,277 | A * | 4/1984 | Lewis | 175/66 |
| 4,482,704 | A * | 11/1984 | Luetzelschwab | 366/136 |
| 4,664,528 | A * | 5/1987 | Rodgers et al. | 366/142 |
| 4,863,277 | A * | 9/1989 | Neal et al. | 366/137 |
| 5,052,486 | A * | 10/1991 | Wilson | 166/308.4 |
| 5,103,908 | A * | 4/1992 | Allen | 166/285 |
| 5,624,182 | A * | 4/1997 | Dearing et al. | 366/2 |
| 5,896,883 | A * | 4/1999 | Khalatbari et al. | 137/259 |
| 6,216,801 | B1 * | 4/2001 | Jonnes | 175/65 |
| 2003/0137895 | A1 * | 7/2003 | Hummer | 366/137 |
| 2004/0016572 | A1 * | 1/2004 | Wylie et al. | 175/66 |
| 2005/0219945 | A1 * | 10/2005 | Kelley et al. | 366/142 |
| 2006/0225924 | A1 | 10/2006 | Ivan et al. | |
| 2006/0225925 | A1 * | 10/2006 | Ivan et al. | 175/66 |
| 2006/0231259 | A1 * | 10/2006 | Dykstra et al. | 166/305.1 |
| 2008/0049544 | A1 * | 2/2008 | Bingham et al. | 366/101 |
| 2010/0319921 | A1 * | 12/2010 | Eia et al. | 166/305.1 |
| 2011/0299357 | A1 * | 12/2011 | Vasshus et al. | 366/132 |

OTHER PUBLICATIONS

Written Opinion issued in PCT/EP2008/065842, mailed on Mar. 17, 2009, 6 pages.

Examiner's Report issued in corresponding Canadian Application No. 2,705,933; Dated Mar. 7, 2012 (2 pages).

Examination Report issued in corresponding British Application No. GB1009843.2; Dated Sep. 27, 2011 (1 page).

* cited by examiner

WELLBORE FLUID MIXING SYSTEM

BACKGROUND

1. Field of the Disclosure

Embodiments disclosed herein relate generally to systems and methods of mixing fluids used in oilfield applications. More specifically, embodiments disclosed herein relate to systems and methods for mixing wellbore fluids and fluids used for production enhancement using a modular system. More specifically still, embodiments disclosed herein relate to system and methods for mixing, storing, and injecting fluids during varied operations at drilling and production location.

2. Background Art

When drilling or completing wells in earth formations, various fluids typically are used in the well for a variety of reasons. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, fluid used for emplacing a packer, abandoning the well or preparing the well for abandonment, and otherwise treating the well or the formation.

In general, wellbore fluids should be pumpable under pressure down through strings of drilling pipe, then through and around the drilling bit head deep in the earth, and then returned back to the earth surface through an annulus between the outside of the drill stem and the hole wall or casing. Beyond providing drilling lubrication and efficiency, and retarding wear, drilling fluids should suspend and transport solid particles to the surface for screening out and disposal. In addition, the fluids should be capable of suspending additive weighting agents (to increase specific gravity of the mud), generally finely ground barites (barium sulfate ore), and transport clay and other substances capable of adhering to and coating the borehole surface.

While the preparation of wellbore fluids may have a direct effect upon their performance in a well, as well as the production of the well, methods of fluid preparation have changed little over the past several years. Typically, the mixing method still employs manual labor to empty sacks of fluid components into a hopper to make an initial fluid composition. However, because of agglomerates formed as a result of inadequate high shear mixing during the initial production of the fluid composition, screen shakers used in a recycling process to remove drill cuttings from a fluid for recirculation into the well also filter out as much as thirty percent of the initial fluid components prior to the fluid's reuse. In addition to the cost inefficiency when a drilling fluid is inadequately mixed, and thus components are aggregated and filtered from the fluid, the fluids also tend to fail in some respect in their performance downhole. Inadequate performance may result from the observations that the currently available mixing techniques hinder the ability to reach the fluids rheological capabilities. For example, it is frequently observed that drilling fluids only reach their absolute yield points after downhole circulation. The mixing of production fluids including, for example, produced water and polymers, may also include the manual mixing of dry components in a hopper, then adding the dry components to a liquid. Similar to the mixing of drilling fluids, improper mixing of production fluids may result in fluids that fail to enhance the recovery of hydrocarbons from formation when pumped downhole.

Furthermore, for wellbore fluids that incorporate a polymer that is supplied in a dry form, the adequacy of the initial mixing is further compounded by the hydration of those polymers. When polymer particles are mixed with a liquid such as water, the outer portion of the polymer particles wet instantaneously on contact with the liquid, while the center remains unwetted. Also effecting the hydration is a viscous shell that is formed by the outer wetted portion of the polymer, further restricting the wetting of the inner portion of the polymer. These partially wetted or unwetted particles are known in the art as "fisheyes." While fisheyes can be processed with mechanical mixers to a certain extent to form a homogenously wetted mixture, the mechanical mixing not only requires energy, but also degrades the molecular bonds of the polymer and reduces the efficacy of the polymer. Thus, while many research efforts in the fluid technology area focus on modifying fluid formulations to obtain and optimize rheological properties and performance characteristics, the full performance capabilities of many of these fluid are not always met due to inadequate mixing techniques or molecular degradation due to mechanical mixing.

Accordingly, there exists a need for improved techniques for mixing wellbore fluids.

SUMMARY OF THE DISCLOSURE

In one aspect, embodiments disclosed herein relate to a system for mixing fluids for oilfield applications, the system including a first storage vessel configured to hold a first material and a first mixing device in fluid communication with the first storage vessel. The system also including a second mixing device in fluid communication with the first mixing device and a second storage vessel in fluid communication with the second mixing device, wherein the second storage vessel is configured to hold a second material. Additionally, the system including a pump in fluid communication with at least the second storage vessel and the first mixing device, wherein the pump is configured to provide a flow of the second material from the second storage vessel to the first mixing device, and wherein the first mixing device is configured to mix the first material and the second material to produce a wellbore fluid.

In another aspect, embodiments disclosed herein relate to a method of mixing a wellbore fluid, the method including providing a first material from a first storage vessel and a second material from a second storage vessel to a mixer, and mixing the first material and the second material in the mixer to produce the wellbore fluid. Additionally, transferring the wellbore fluid to a second mixer, shearing the wellbore fluid in the second mixer, and transferring the wellbore fluid to the second storage vessel.

In another aspect, embodiments disclosed herein relate to a method of injecting a wellbore fluid into a wellbore, the method including transferring a first material from a first storage vessel to a static mixer and transferring a second material from a second storage vessel to the static mixer. The method also including mixing the first material and the second material to produce the wellbore fluid and transferring the wellbore fluid to a dynamic mixer. Additionally, the method including shearing the wellbore fluid with the dynamic mixer, storing the wellbore fluid in the second storage vessel, and injecting the wellbore fluid into the wellbore.

Other aspects and advantages of the invention will be apparent from the following description and the appended claims.

DETAILED DESCRIPTION

Figure 1:
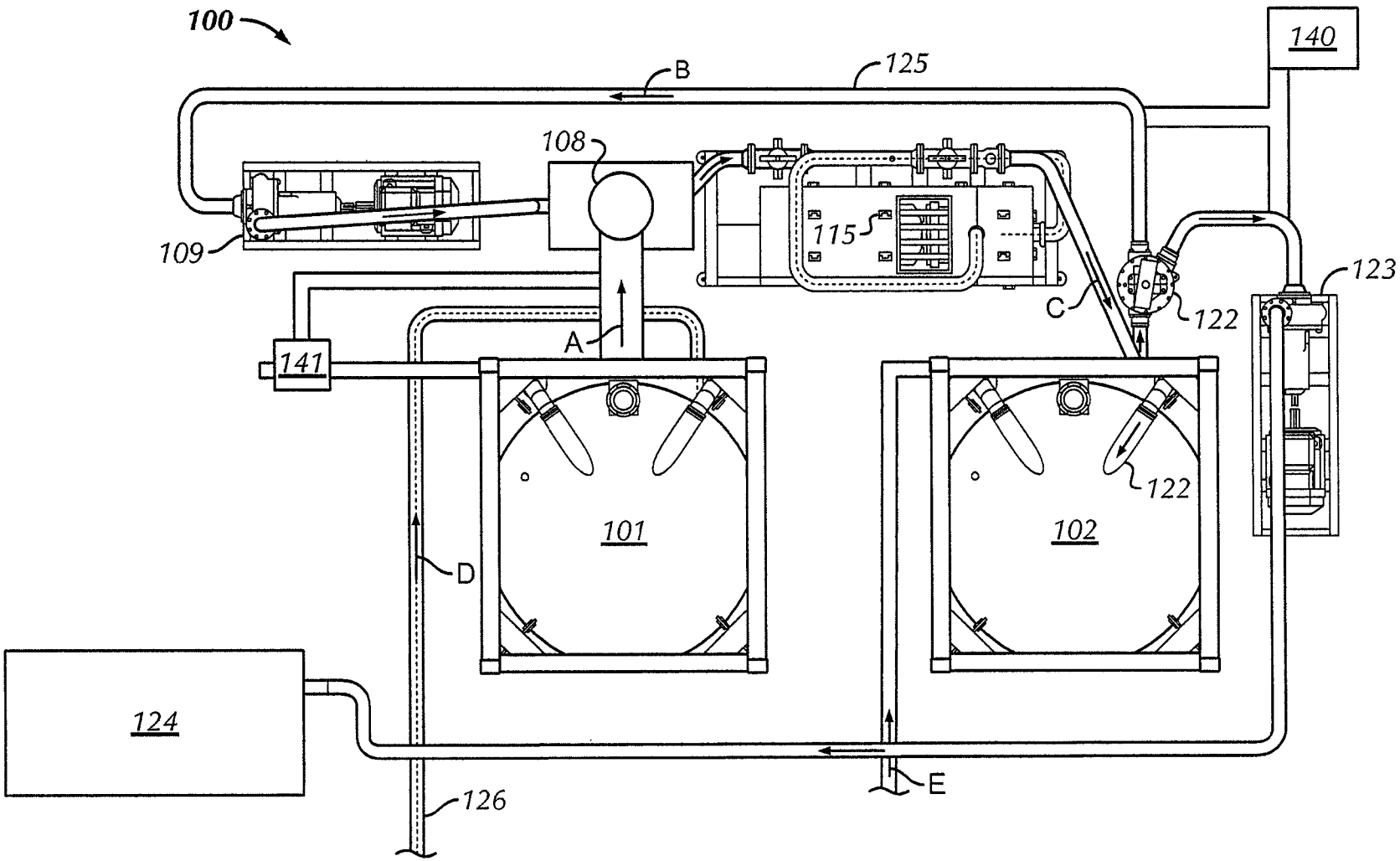
FIG. 1 is a top view of a schematic representation of a system according to an embodiment of the present disclosure.

Embodiments disclosed herein relate generally to systems and methods of mixing fluids. More specifically, embodiments disclosed herein relate to systems and methods for mixing fluids using a modular system. More specifically still, embodiments disclosed herein relate to system and methods for mixing, storing, and injecting fluids during various operations at drilling, production, and injection locations.

Generally, wellbore fluids are used during different aspects of drilling operations. For example, wellbore fluids, including both water-based and oil-based fluids, are used during the drilling of a wellbore. Such wellbore fluids are typically referred to as drilling fluids or drilling muds, and their use may facilitate drilling of the wellbore by cooling and lubricating a drill bit, removing cuttings from the wellbore, minimizing formation damage, sealing permeable formations, controlling formation pressures, transmitting hydraulic energy to downhole tools, and carrying additives useful in maintaining wellbore integrity or otherwise enhancing drilling. Examples of useful additives that may be carried by drilling fluids include weighting agents, bridging agents, flocculants, deflocculants, clays, thickeners, and other additives known to those of ordinary skill in the art.

Other wellbore fluids may include completion fluids. Completion fluids may be used after the drilling of a well and prior to production to, for example, set production liners, packers, downhole valves, and shoot perforations into a producing zone. Completion fluids typically include brines, such as chlorides, bromides, and formates, but in certain completion operations, may include other wellbore fluids of proper pH, density, flow characteristics, and ionic composition. Those of ordinary skill in the art will appreciate that completions generally include a low percent by weight solids composition and may be filtered prior to injection into a wellbore to avoid introducing solids into the production zone.

In still other operations at a drilling location, wellbore fluids may include fluids used during production of the wellbore. In certain operations, polymers may be pumped into a wellbore to increase the oil released from the formation, thereby increasing production. Generally, production fluids include treatment fluids that may be used during well workover and intervention operations. Such treatment fluids may include various chemical additives including polymers to help stimulate, isolate, or control aspects of reservoir gas or water. In still other operations, treatment fluids may include chemical additives useful in inhibiting scale buildup and corrosion.

Wellbore fluids may also include slurries. Examples of slurries used in a wellbore include slurrified mixtures of cuttings and fluids used during re-injection operations. In such operations, cuttings are ground, mixed with fluid, and then injected into the wellbore via the use of high-pressure injection pumps. The slurry of cuttings and fluid is injected into formation, thereby providing a method of disposing of drill cuttings in environmentally sensitive areas.

Those of ordinary skill in the art will appreciate that wellbore fluids are used throughout the drilling operation, such as during drilling, completion, production, and post-production. Wellbore fluids used in the above-described operations may be transported to a drilling location pre-mixed, however, in many drilling operations it is desirable for wellbore fluids to be mixed at a drilling location. Mixing the wellbore fluids on location allows drilling engineers to refine the fluids by adding chemicals or otherwise adjusting properties of the wellbore fluid in response to changing downhole conditions. Embodiments of the present disclosure may thus allow drilling engineers systems and methods for mixing and injecting wellbore fluids at a drilling location. However, those of ordinary skill in the art will appreciate that embodiments of the present disclosure may also be used at fluid manufacturing facilities to further facilitate the production of wellbore fluids for downhole injection.

Referring to FIG. 1, a top view of a schematic representation of a system 100 according to an embodiment of the present disclosure is shown. In this embodiment, system 100 includes a first storage vessel 101 and a second storage vessel 102. First and second storage vessels 101 and 102 may include any type of vessel used to store solids and liquids used in drilling operations. However, those of ordinary skill in the art will appreciate that depending on the specific properties of the materials being mixed by system 100, the type of storage vessels 101 and 102 may vary. For example, in one embodiment, one or more of storage vessels 101 and 102 may include a pneumatic storage vessel.

System 100 also includes a first mixing device 108 and a second mixing device 115. While details of first and second mixing devices 108 and 115 will be described below in detail, generally, first and second mixing devices 108 and 115 provide for the mixing of a first material with a second material. System 100 may further include one or more pumps 109 and 123 configured to provide a flow of materials between first and second storage vessels 101 and 102, mixers 108 and 115, and other aspects of the drilling, production, and injection operations.

During operation of system 100, a first material is transferred from first storage vessel 101 along flow path A. The first material may be any type of material used in the production of wellbore fluids. In this embodiment, the first material is a dry solid-state material (e.g., a dry polymer). As such, the first material may be transferred from first storage vessel 101 via a feeder, such as a screw auger, to first mixing device 108. Contemporaneous with the transfer of the first material from first storage vessel 101 to first mixing device 108, a second material is transferred from second storage vessel 102 to first mixing device 108. In this embodiment, the second material is a liquid-phase, such as water or a brine solution. As illustrated, the fluid material is transferred from second storage vessel 102 along conduit 125 via flow path B.

To facilitate the transfer of the second material from second storage vessel 102 to first mixing device 108, first pump 109, in this embodiment a centrifugal pump, is disposed therebetween. First pump 109 then provides the second material to first mixing device 108, wherein first mixing device 108 provides a dose of second material, mixes the first and second material, then provides a flow of the produced wellbore fluid to second mixing device 115. Second mixing device 115 then provides a shearing action to the produced wellbore fluid, further mixing the first material with the second material.

Second mixing device 115 then transfers the produced wellbore fluid to second storage vessel 102, as illustrated by flow path C. The produced wellbore fluid may be stored within second storage vessel 102 until use of the wellbore fluid is required in the drilling, production, or injection operation. When the wellbore fluid is required for the drilling operation, valve 122 is opened, and a second pump 123 is actuated to provide a flow of the produced drilling fluid from second storage vessel 102 to another component of the drilling operation, in this embodiment, an injection pump 124. In other embodiments, second pump 123 may provide a flow of wellbore fluid from second storage vessel 102 to other components, such as another storage vessel (not shown), further mixing apparatus (not shown), or directly into a wellbore.

Those of ordinary skill in the art will appreciate that other operations may occur simultaneous to the mixing of the wellbore fluid. For example, in one embodiment, additional first material may be added to first storage vessel 101 while the wellbore fluid is being mixed. In such an operation, the additional first material may be injected into first storage vessel 101 via a transfer pipe 126 along flow path D. Similarly, second material, such as produced water, may be injected into second storage vessel 102 via a second transfer pipe 142 along flow path E. Specifics of the components of mixing system 100 will be discussed in detail below, but generally, those of ordinary skill in the art will appreciate that system 100 may be disposed on both land and offshore drilling, production, and injection rigs, platforms, jack-ups and/or on transportation vessels, such as boats and storage trucks. As such, steps of the above-described operation may be completed during the transportation of materials to a drilling location or at a drilling location. Furthermore, embodiments of the present disclosure may include additional components, such as additional pumps, storage tanks, and valves, to further enhance the efficiency of system 100. Several specific wellbore fluid mixing systems 100, and components thereof in accordance with the present disclosure will now be described in detail.

In certain embodiments, system 100 may also include additive injection systems 140, configured to provide additional additives to the fluids produced within the system. In one aspect, additive injection system 100 is configured to provide an additive to the second material from second storage vessel 102. In such an embodiment, the additive may be added to the second material prior to or after mixing with the first material. In other embodiments, the additive may be added to the wellbore fluid prior to injection into a wellbore. Those of ordinary skill in the art will appreciate that additive injection system may be disposed in fluid communication with other aspects of system 100, such as between second mixing device 115 and second storage vessel 102. Those of ordinary skill in the art will further appreciate that injected additives, such as polymers, may be used during the mixing of fluids for drilling, production, and injection operations. Furthermore, depending on the specific requirements of the mixing operation, the additive may include liquids, solids, and combinations thereof.

In still other embodiments, system 100 may include other devices, such as dust collectors. In an embodiments including a dust collector 141, the dust collector 141 may be configured to prevent the escape of solid particles from first storage vessel 101 during the transfer of first material into or out of first storage vessel 101. As illustrated, dust collector 141 is configured to separate particles from the air before entering the atmosphere. As such, particles are returned to system 100, while cleaned air is allowed to enter the atmosphere.

Figure 2A:
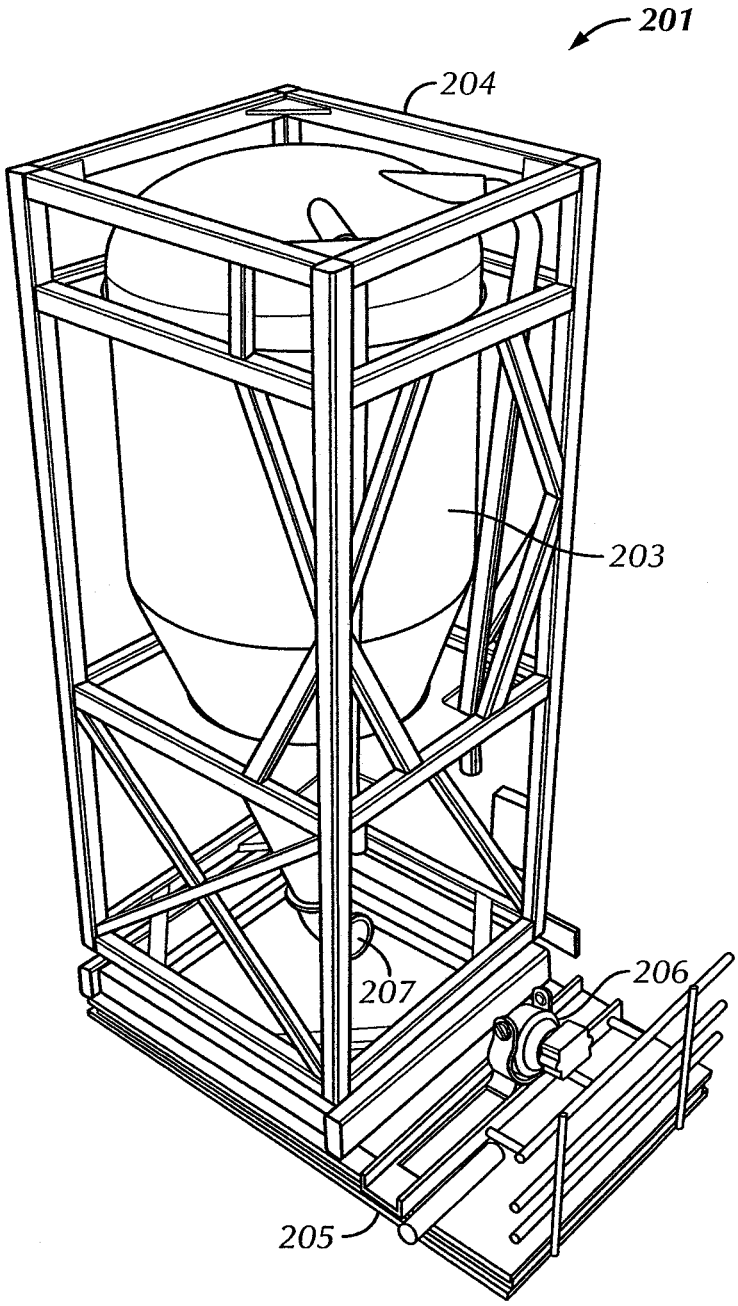
FIG. 2A is a detailed view of a storage vessel according to an embodiment of the present disclosure.

Referring to FIG. 2A, an exemplary storage vessel 201 in accordance with an embodiment of the present disclosure is shown. In this embodiment, storage vessel 201 is a pneumatic storage vessel, such as an ISO-PUMP, commercially available from M-I L.L.C., Houston, Tex. Generally, pneumatic storage vessel 201 includes a pressure vessel 203, an external frame 204, and a rig installation module 205. Rig installation module 205 may include a plurality of valves (not specifically shown) such that pneumatic storage vessel 201 may be set-up at a drilling location and/or transported on a transportation vessel.

In one embodiment, pneumatic storage vessel 201 may include a pressure vessel 203 capable of holding 30 tons of material and having a capacity of approximately 95 bbl. Additionally, pneumatic storage vessel 201 may be coupled to an air supply device, such that air may be injected into pressure vessel 203 to allow for the pneumatic transfer of materials contained therein. Those of ordinary skill in the art will appreciate that pneumatic storage vessel 201 may be used to hold and/or transfer dry and liquid materials depending on the specific requirements of the operation. However, the pressure vessel 203 holding dry materials should be isolated from liquids that may be stored in other storage vessels so that the pneumatic transfer ability of the dry materials is not impeded. Additionally, pneumatic storage vessel 201 does not require that the pneumatic transfer function be used when removing materials from pressure vessel 203. For example, in one embodiment, pressure vessel 203 may be used to hold a dry polymer. A valve 207 may then be opened, and the dry polymer may flow from pressure vessel 203 to another component of the system attached thereto by gravity. In such an embodiment, the air supply may not need to be actuated in order to facilitate the flow of dry polymer from pressure vessel 203.

However, in embodiments wherein the dry polymer becomes compacted within pressure vessel 203, a drilling engineer may actuate the air supply, such that a flow of gas (e.g., nitrogen or oxygen) facilitates the transfer of the dry polymer out of pressure vessel 203. In still other embodiments, gas may be supplied from a certain point within pressure vessel 203, such as near the bottom, to help break apart compacted dry polymers. In such an embodiment, the air may be used to "fluff" the dry material, such that the material may flow more freely from pressure vessel 203.

Those of ordinary skill in the art will appreciate that combinations of gravity feed and pneumatic transferring may be used individually or in combination with transferring materials out of pressure vessel 203. Those of ordinary skill in the art will further appreciate that pneumatic storage vessel 201 may also include varied internal or external components not discussed in detail herein. For example, in one embodiment, a pressure vessel including a plurality of valves 207 or outlets (not illustrated) may be used. In such an embodiment, the internal geometry of pressure vessel 203 may include a honeycomb shaped lower portion that may further enhance the transferability of dry materials contained therein. Other design variations may include multiple cone lower portions, chisel shaped lower portions, and horizontal or vertical rotational feeder systems. Additionally, pneumatic storage vessel 201 may also include other components, such as weighing devices 206, which further facilitate the operation by allowing for weight-based dosing of one or more materials contained therein.

Figure 2C:
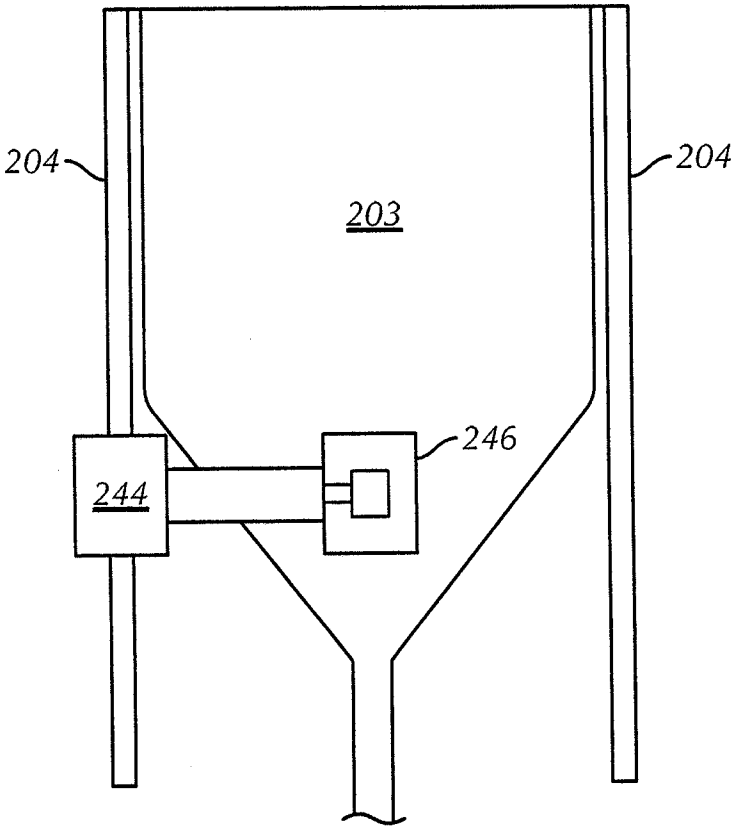
FIG. 2C is a cross-sectional view of a pressure vessel according to an embodiment of the present disclosure.
Figure 2B:
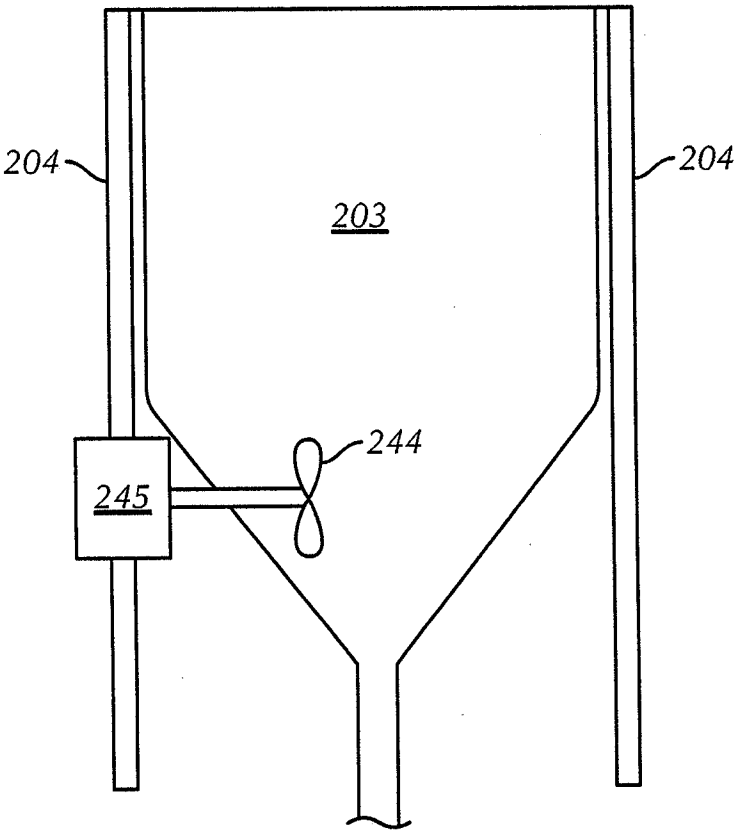
FIG. 2B is a cross-sectional view of a pressure vessel according to an embodiment of the present disclosure.

Referring now to FIG. 2B, a cross-section of a storage vessel according to embodiments of the present disclosure is shown. In this embodiment, a pressure vessel 203 disposed within an external frame 204 includes an agitator 244. Agitator 244 is disposed within pressure vessel 203 and is functionally coupled to a motor 245. When actuated, motor 245 causes agitator 244 to move so as to create a flow of material in the pressure vessel 203. Agitator 244 may thus be disposed within storage vessel, such as second storage vessel of FIG. 1, to circulate the material, such as a wellbore fluid, within the pressure vessel 203. By circulating the material within pressure vessel 203, materials containing solids that might otherwise drop out of suspension, or alternatively, materials that might agglomerate, remain fluid.

Referring now to FIG. 2C, a cross-section of a storage vessel according to embodiments of the present disclosure is shown. In this embodiments, a pressure vessel 203 disposed within an external frame 204 includes a mixer 246. Mixer 246 is functionally coupled to a motor 244. Upon actuation, motor 244 causes mixer 246 to substantially continuously mix the material within pressure vessel 203. Such a configuration may thereby allow system 100 of FIG. 1 to include three mixers. Depending on the requirements of the operation, mixer 246 may include a shear mixer, static mixer, and/or dynamic mixer. As such, materials stored within pressure vessel 203 may be substantially continuously mixed while being stored. Such an embodiment may thereby allow materials that may otherwise separate during storage to be storage for longer periods of time, while still remaining substantially mixed.

Figure 2D:
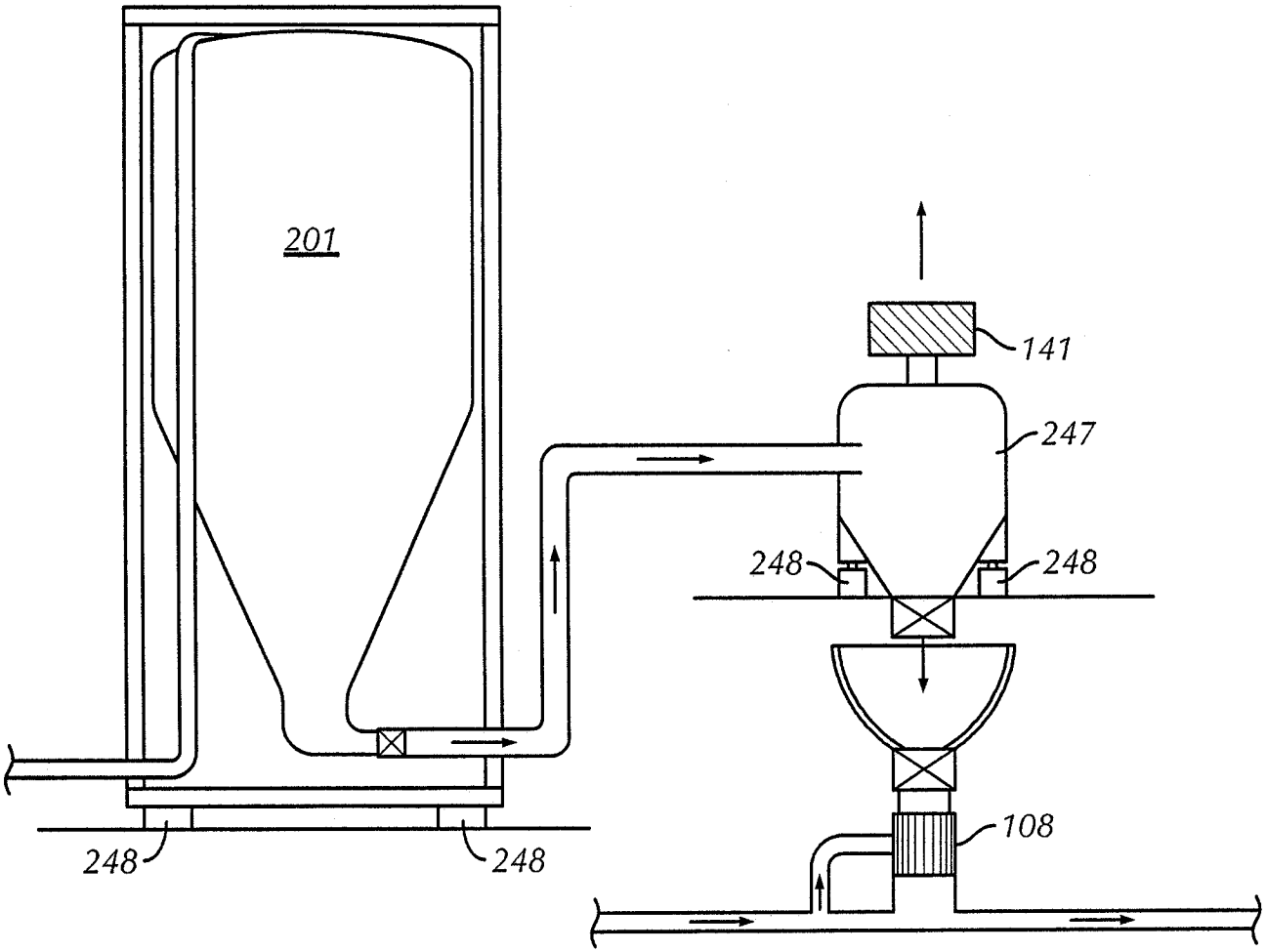
FIG. 2D is a schematic view of a system according to an embodiment of the present disclosure.

Referring now to FIG. 2D, a schematic view of a system according to embodiments of the present disclosure is shown. In this embodiment, a first storage vessel 201 is in fluid communication with a surge tank 247. Surge tank 247 is configured to receive a flow of a first material from first storage vessel 201, and allow the first material to discharge into a first mixer 108, while gas is allowed to exit the system through dust collector 141. In such a system, surge tank 247 may be internally coated to provide a slick, non-adhering surface to provide a uniform flow of materials, thereby preventing arching, bridging, and plugging. Additionally, the system may be configured with a plurality of weighing devices 248, such as load cells, such weight measurements of materials within components of the system may be determined. Those of ordinary skill in the art will appreciate that a system having surge tank 247 and dust collector 141 may thereby enhance the production of fluids for a drilling, production, or injection operation, while preventing the release of particles into the atmosphere.

Referring to FIGS. 1 and 2A together, one or more of first and second storage vessels 101 and 102 may include pneumatic storage vessels, as described above. However, in certain embodiments a combination of pneumatic and non-pneumatic storage vessels may be used so that only one of the materials contained within storage vessel 101 or 102 is transferred pneumatically. During operation, first storage vessel 101 is generally configured to hold a first material, while second storage vessel 102 is configured to hold a second material. In one aspect, the first material may include a solid material, more specifically, a dry solid material used in the production of wellbore fluids. The second material may thus include a liquid state material, more specifically, a water or brine, as well as produced water from a production well.

As illustrated in FIG. 1, first storage vessel 101 is in fluid communication with a first mixing device 108. In this embodiment, first mixing device 108 is a static mixer, such as a hopper. First mixing device 109 is disposed to receive a flow of the first material from first storage vessel 101, and mix the first material with a flow of the second material from second storage vessel 102. Those of ordinary skill in the art will appreciate that in other embodiments, first mixing device 108 may include a dynamic mixer.

Figure 3:
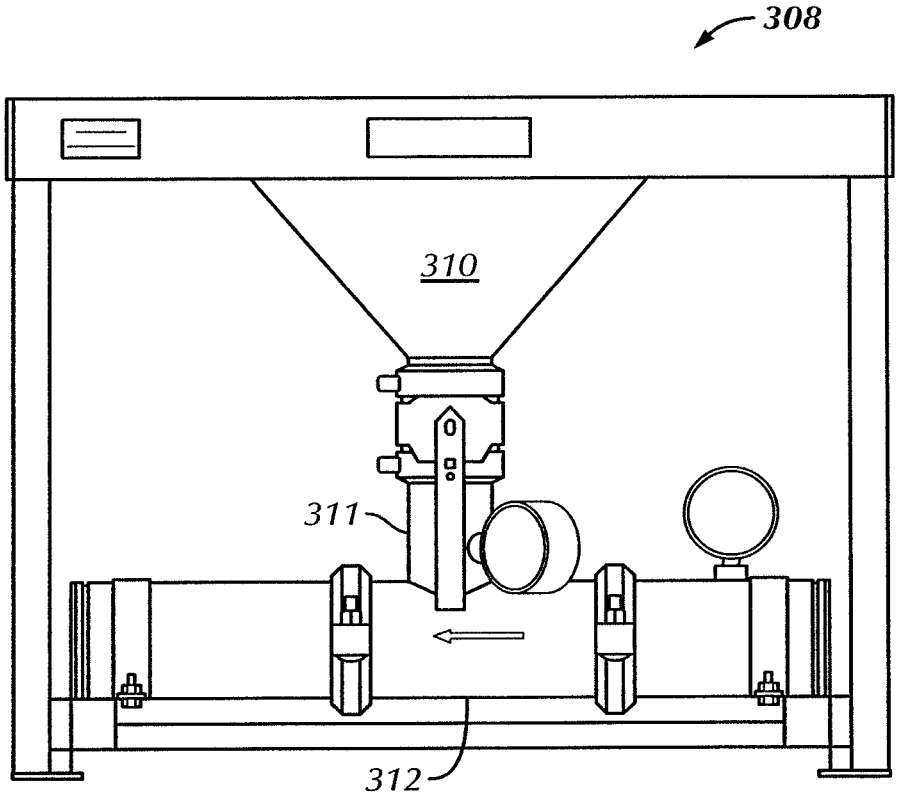
FIG. 3 is a detailed view of a mixer according to an embodiment of the present disclosure.

Referring to FIG. 3, a detailed illustration of first mixing device 308 in accordance with embodiments disclosed herein is shown. In this embodiment, first mixing device 308 includes an inlet 310 for receiving the first material. First mixing device 308 also includes a first chamber 311 for receiving a partial flow of the second material, in this example a water-based fluid. The partial flow of the fluid flows accelerates into first chamber 311, where the first material and the second material commingle. The commingled materials are then accelerated into second chamber 312. In second chamber 312, the flow of the second material is accelerated through a nozzle (not shown). The commingled flow of materials from first chamber 312 is then injected into second chamber 312, wherein the first and second materials thoroughly mix, and exit first mixing device 308 through a diffuser (not shown).

After the first and second materials are mixed in first mixing device 308, the produced wellbore fluid is transferred to a second mixing device. The second mixing device may include any type of wellbore fluid mixing device known in the art, including dynamic mixers. Generally, high shear dynamic mixers, such as the in-line mixer illustrated here, may provide for efficient, aeration-free, self-pump mixing to further homogenize the dispersion of the first material within the second material.

Figure 4C:
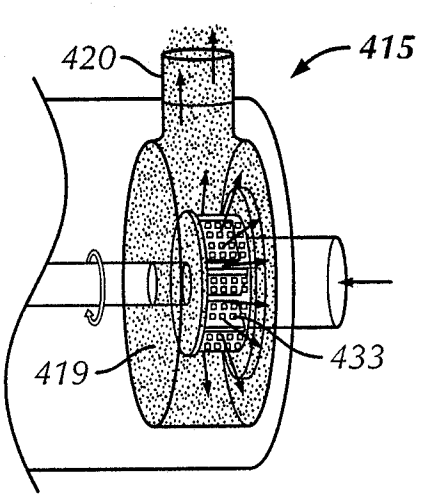
FIGS. 4A-C are detailed views of a second mixer according to embodiments of the present disclosure.
Figure 4B:
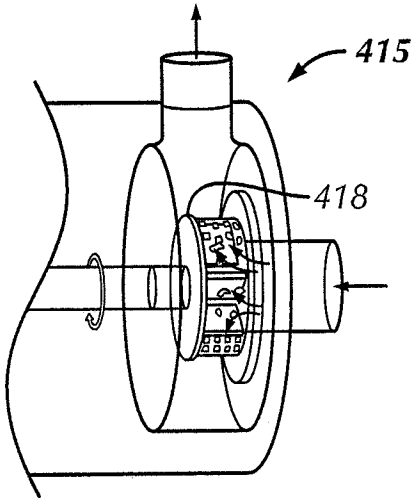
Figure 4A:
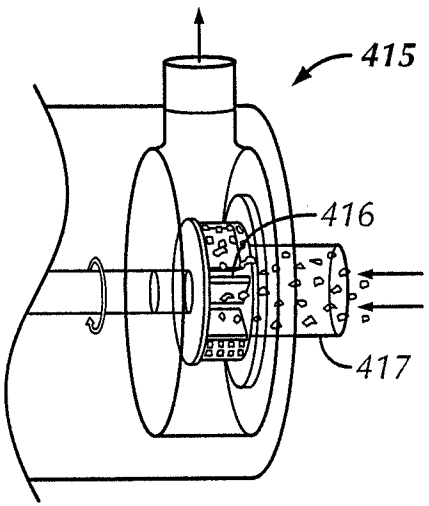

Referring to FIGS. 4A-C, a detailed illustration of a second mixing device 415 in accordance with embodiments disclosed herein is shown. In this embodiment, high-speed rotation of rotor blades 416 provides a suction force on inlet 417, thereby drawing the mixed first and second materials into the rotor/stator assembly (FIG. 4A). Centrifugal force then drives the materials toward a work portion 418, where the first and second materials are subjected to a milling action (FIG. 4B). After the first and second materials are subjected to the milling action of work portion 418, the produced wellbore fluid is hydraulically sheared as the materials are forced out of perforations 433 in the stator 419 at a high velocity (FIG. 4C). The produced wellbore fluid then exits second mixing device 415 through outlet 420.

Those of ordinary skill in the art will appreciate that second mixing device 415 is merely exemplary of one type of mixing device that may be used in accordance with embodiments disclosed herein. In other embodiments, other mixers including other types of dynamic mixers may be used in addition to or in place of second mixing device 415 as discussed above.

Referring back to FIG. 1, after the produced wellbore fluid exits second mixing device 115, as indicated at C, the produced wellbore fluid flows into second storage vessel 102. In this embodiment, the produced wellbore fluid is injected into second storage vessel 102 via top inlet 121. The produced wellbore fluid may then be stored in second storage vessel 102 until a drilling engineer determines that the operation requires the injection of the wellbore fluid into the wellbore. Those of ordinary skill in the art will appreciate that mixing of additional wellbore fluid may continue, even as produced wellbore fluid is injected into second storage vessel 102. As such, produced wellbore fluid may commingle with the second material in second storage vessel 102. The concentration of first material within second material may be controlled by limiting the total volume of first material mixed with second material, thus any commingling that may occur within second storage vessel 102 will not have a negative effect on the final produced wellbore fluid.

When the drilling engineer decides to inject the produced wellbore fluid into the wellbore, a valve 122 may be opened, thereby allow the wellbore fluid to be pumped via a second pump 123 from second storage vessel 102 to an injection pump 124. In this embodiment, second pump 123 may be a centrifugal mixing pump, thereby providing additional mixing of the wellbore fluid prior to injection into the wellbore. However, those of ordinary skill in the art will appreciate that in other embodiments, second pump 123 may be any type of centrifugal or positive displacement pump known in the art, including, for example, diaphragm, screw type, plunger, rotary, or hydrostatic pump. Similarly, first pump 109, described above, may also be any type of pump known in the art.

Figure 5:
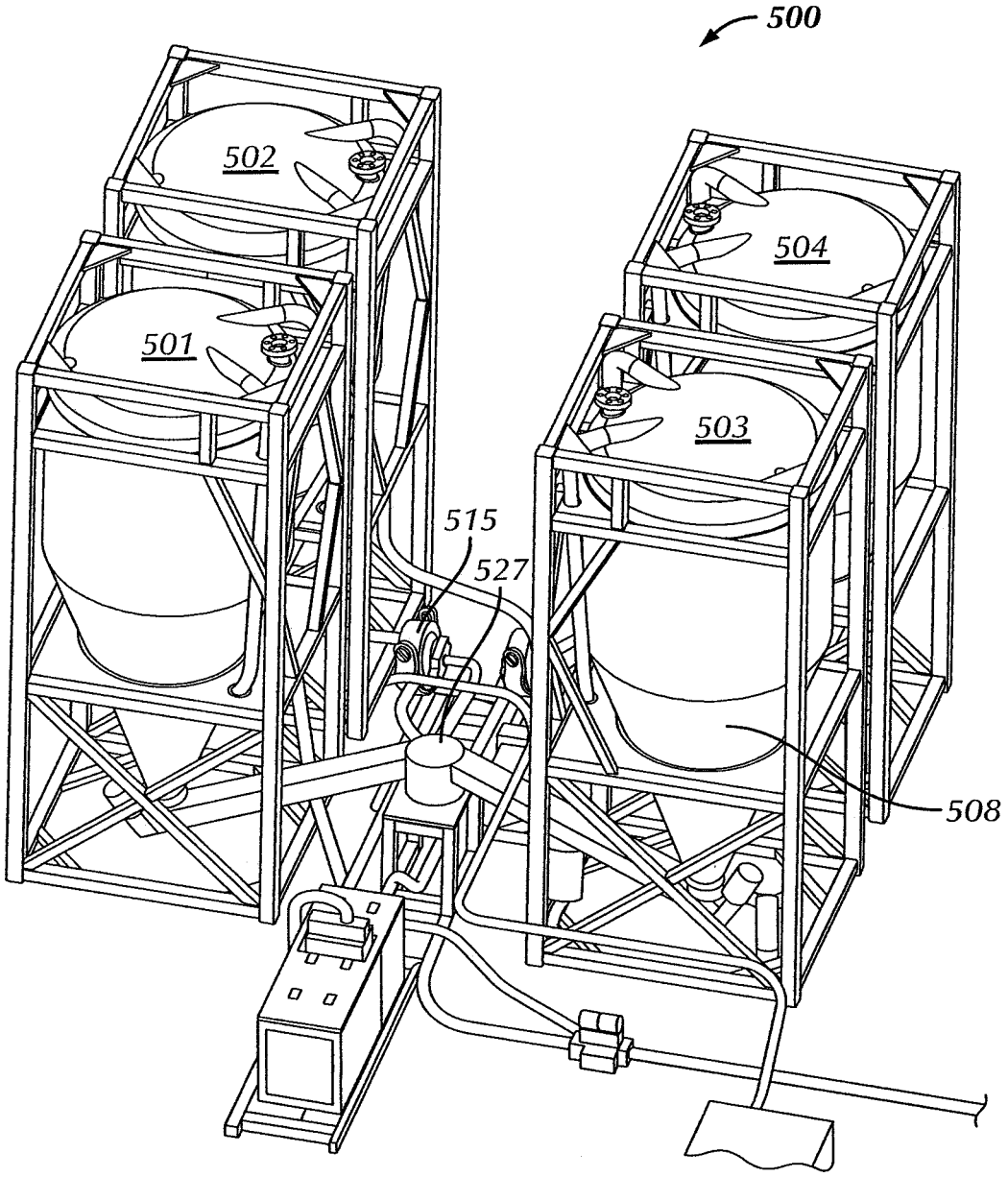
FIG. 5 is an elevation view of a schematic representation of a system according to an embodiment of the present disclosure.

Referring to FIG. 5, an elevation view of a system 500 according to an embodiment of the present disclosure is shown. In this embodiment, system 500 includes four storage vessels, 501, 502, 503, and 504. In such a configuration, storage vessels 501 and 503 are configured to hold a first material, such as a dry powder, while storage vessels 502 and 504 are configured to hold a second material, such as a liquid and/or a produced wellbore fluid. While the operation of system 500 is similar to the operation of system 100 of FIG. 1, for clarity, the differences between the systems will be described below.

During operation of system 500, a first material is transferred from one or more of storage vessels 501 and 503 via feeder 527 to first mixing device 508. Simultaneously, a second material is transferred from storage vessels 502 and 504 to first mixing device 508. The first and second materials are mixed in first mixing device 508 (e.g., a static mixer), then transferred to second mixing device 515 (e.g., a dynamic mixer). The first and second materials are then sheared in second mixing device 515, and the produced wellbore fluid is transferred back to storage vessels 502 and 504 for storing prior to injection into the wellbore.

Those of ordinary skill in the art will appreciate that depending on the volume of wellbore fluid required and/or the rate of injection, additional storage vessels, mixers, and pumps may be added to system 500. For example, in certain embodiments, it may be advantageous to have three, four, or more storage vessels each for the storage of first and second materials, as well as the storage of the produced wellbore fluid. Thus, embodiments having six, eight, or more storage vessels are within the scope of the present disclosure. Additionally, in certain embodiments the produced wellbore fluid may be transferred to a storage vessel otherwise not included in the mixing process. In such an embodiment, each of the storage vessels may be configured to transfer and/or store a discrete reagent or product of the mixing operation.

Figure 6:
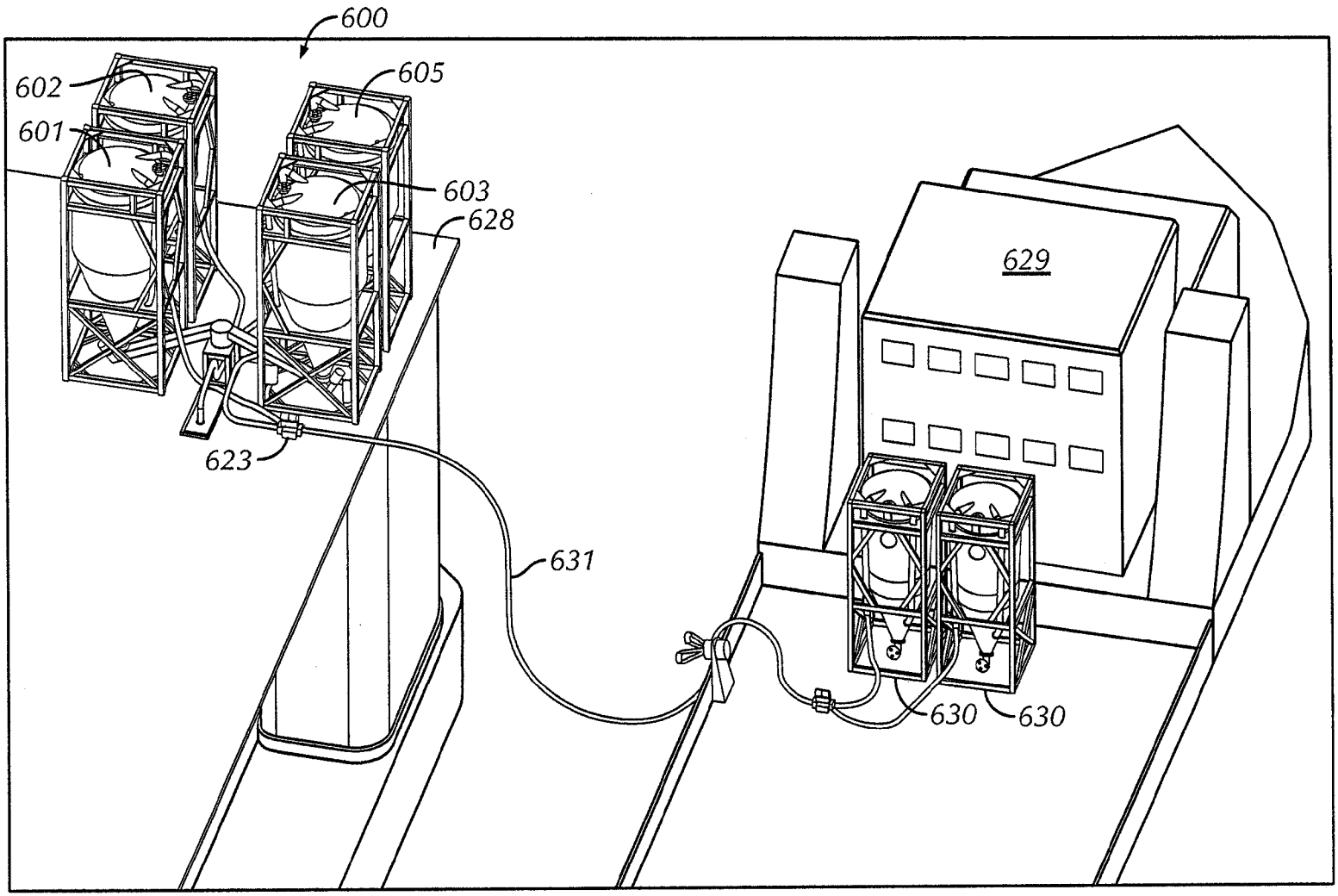
FIG. 6 is a view of a schematic representation of a system according to an embodiment of the present disclosure.

Referring to FIG. 6, a system for producing wellbore fluids according to one embodiment of the present disclosure is shown. In this embodiment, a mixing system 600 is disposed on an offshore drilling rig 628. In other embodiments, rig 628 may be a platform, jack-up, or other type of offshore location used in drilling, production, an injection. As illustrated, a transportation vessel 629 having two storage vessels 630 on its deck is shown proximate offshore drilling rig 628. Materials are transferred from storage vessels 630 to system 600 via transportation line 631. Depending on the type of materials being transferred, a valve 632 may be actuated to allow a flow of dry materials into storage vessels 601 and 603 or a liquid material (e.g., produced water from a production well) may be allowed to flow into storage vessels 602 and 604. In other embodiments, produced drilling fluids may be allowed to flow from storage vessels 602 and 604 from offshore drilling rig 628 to transportation vessel 629 for transport to another drilling operation. Additionally, as described above, materials may be transferred from transportation vessel 629 to system 600 while a mixing operation is occurring. Those of ordinary skill in the art will appreciate that in other embodiments, the systems disclosed herein may also be used at onshore drilling, production, or injection locations.

In accordance with any of the above-described embodiments, after producing a wellbore fluid, the fluid may be transferred to an injection pump for injection downhole. In certain embodiments, the injection pressure required to inject the wellbore fluid downhole may require use of a high-pressure injection pump, such as pump 124 in FIG. 1. Such a pump may be beneficial when injecting wellbore fluids, such as slurries of cuttings for re-injection. Alternatively, such as during the production of drilling fluids, the produced wellbore fluid may be transferred to a pump for injection into the wellbore, or may be transferred to another components on a rig for mixing with additional drilling fluid additives.

Advantageously, embodiments of the present disclosure may allow for the efficient mixing and storage of wellbore fluids for use at drilling, production, and injection locations. Depending on the type of wellbore fluid being produced, the types of materials being mixed may vary; however, the system may be modulated to allow for the use of multiple materials. For example, in an embodiment wherein a slurry for re-injection is being mixed, the system may have a storage vessel configured to store cuttings and a second storage vessel configured to store a water or brine solution. Similarly, in an embodiment wherein a drilling fluid is being mixed, the system may have a storage vessel configured to store weighting agents, such as micronized barite, and a second storage vessel configured to store a base fluid, such as water or oil. In still other embodiments, wherein a fluid used in completion or production is being mixed, a storage vessel may be configured to store a dry polymer, while a second storage vessel is configured to store a liquid-phase, such as water, brine solution, or produced water.

Because embodiments of the present disclosure may be contained on a skid, the entire mixing system may be transferred and installed at a drilling, production, or injection operation, such as on an offshore rig. In such an embodiment, the storage vessels, pumps, and mixers may be included on a skid, which may then be modularly coupled with an injection system already existing at a drilling location. Additionally, because the system is substantially self-contained, the system takes up less deck space, which is at a premium on offshore rigs. Also advantageously, embodiments disclosed herein may allow for faster set-up and take down times while installing or removing the system from a drilling, production, or injection location.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

The invention claimed is:

1. A system comprising:

a first storage vessel holding a first material;

a first mixing device in direct fluid communication with the first storage vessel, a pump and a second mixer;

a second storage vessel in direct fluid communication with the second mixing device and the pump, wherein the second storage vessel holds a second material; and wherein the pump provides a flow of the second material from the second storage vessel to the first mixing device;

wherein the first mixing device mixes the first material and the second material to produce a wellbore fluid and deliver the wellbore fluid to the second mixing device, and wherein the second storage device receives the wellbore fluid from the second mixing device.

2. The system of claim 1, further comprising:

a second pump in fluid communication with the second storage vessel; and an injection pump in direct fluid communication with the second pump;

wherein the second pump provides a flow of the wellbore fluid from the second storage vessel to the injection pump.

3. The system of claim 2, further comprising:

a valve disposed in fluid communication with the first pump, the second pump, and the second storage vessel;

wherein the valve is configured to control a flow of material between the second storage vessel and the first pump; and wherein the valve controls a flow of the wellbore fluid between the second storage vessel and the second pump.

4. The system of claim 1, wherein at least one of the first storage vessel and the second storage vessel is coupled to an air supply device.

5. The system of claim 1, wherein the first mixing device comprises a static mixer.

6. The system of claim 1, wherein the second mixing device comprises a dynamic shearing mixer.

7. The system of claim 1, wherein the system is disposed at an offshore drilling location.

8. The system of claim 1, further comprising:

a third storage vessel in fluid communication with the first mixing device; and a fourth storage vessel in fluid communication with the second mixing device.

9. The system of claim 8, wherein at least one of the second storage vessel and the fourth storage vessel is configured to receive the wellbore fluid.

10. The system of claim 1, wherein the system is configured to be modularly disposed at an oilfield location.

11. The system of claim 1, further comprising a feeder coupled to the first mixing device.

12. The system of claim 11, wherein the feeder is a screw auger.

* * * * *